US007520732B2

(12) United States Patent
Agner et al.

(10) Patent No.: US 7,520,732 B2
(45) Date of Patent: Apr. 21, 2009

(54) PUMP

(75) Inventors: Ivo Agner, Bad Homburg (DE); Matthias Wendt, Usingen (DE)

(73) Assignee: LuK Fahrzeug-Hydraulik GmbH & Co. KG, Bad Homburg, v.d.H (DE)

( * ) Notice: Subject to any disclaimer, the term of this patent is extended or adjusted under 35 U.S.C. 154(b) by 566 days.

(21) Appl. No.: 10/500,000

(22) PCT Filed: Dec. 20, 2002

(86) PCT No.: PCT/DE02/04677

§ 371 (c)(1),
(2), (4) Date: Mar. 24, 2005

(87) PCT Pub. No.: WO03/056179

PCT Pub. Date: Jul. 10, 2003

(65) Prior Publication Data

US 2005/0163631 A1 Jul. 28, 2005

(30) Foreign Application Priority Data

Dec. 27, 2001 (DE) ..... 101 64 277

(51) Int. Cl.
*F01C 19/08* (2006.01)

(52) U.S. Cl. ..... 417/410.3; 418/133; 418/131

(58) Field of Classification Search ..... 417/410.3; 418/30, 131, 133, 134, 259, 266–268
See application file for complete search history.

(56) References Cited

U.S. PATENT DOCUMENTS

| | | | | | |
|---|---|---|---|---|---|
| 3,270,680 | A * | 9/1966 | Beldon | 418/132 |
| 3,554,678 | A * | 1/1971 | Jakoboice et al. | 418/206.6 |
| 3,760,478 | A * | 9/1973 | Harlin | 29/888.025 |
| 4,419,058 | A * | 12/1983 | Franklin et al. | 418/133 |
| 4,443,168 | A * | 4/1984 | Dworak et al. | 418/131 |
| 4,505,655 | A * | 3/1985 | Honaga et al. | 418/133 |
| 5,466,135 | A * | 11/1995 | Draskovits et al. | 418/268 |
| 5,876,194 | A * | 3/1999 | Suelter | 418/259 |
| 6,358,020 | B1 * | 3/2002 | Staton et al. | 417/410.3 |
| 6,641,380 | B1 * | 11/2003 | Nied-Menninger et al. | 418/104 |

FOREIGN PATENT DOCUMENTS

| | | |
|---|---|---|
| EP | 0781924 | 11/2002 |

* cited by examiner

*Primary Examiner*—Charles G Freay
*Assistant Examiner*—Nestor R Ramirez
(74) *Attorney, Agent, or Firm*—Davidson, Davidson & Kappel, LLC

(57) ABSTRACT

A pump, particularly a vane pump or roller cell pump, whereby the vane pump or roller cell pump is provided with a two-stroke contour ring, with a rotor, inside of which vanes or rollers are mounted in a manner that enables them to be radially displaced, with at least one side side plate, which seals the rotating group, with a casing and with a casing cover, whereby the rotor is driven by a shaft and the shaft is mounted inside the casing and, optionally, inside the cover.

17 Claims, 4 Drawing Sheets

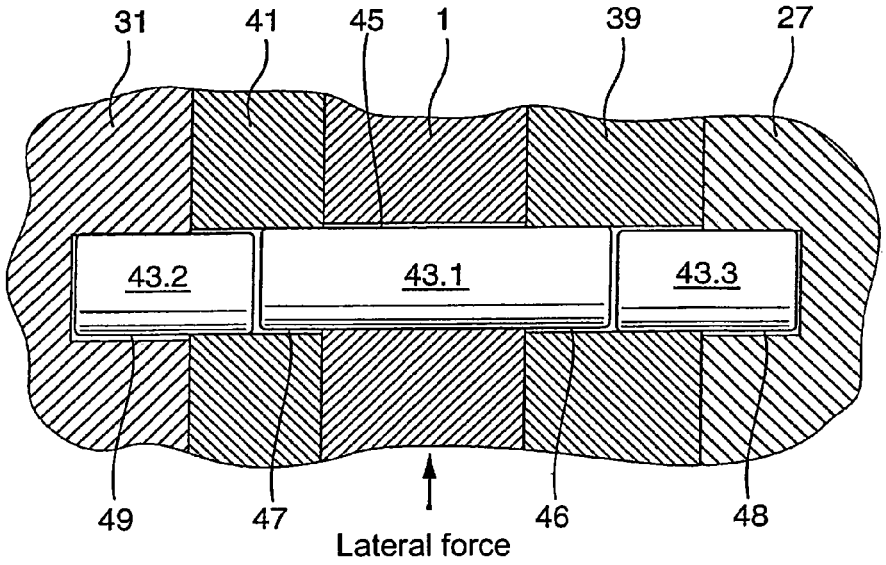
Fig. 3.1
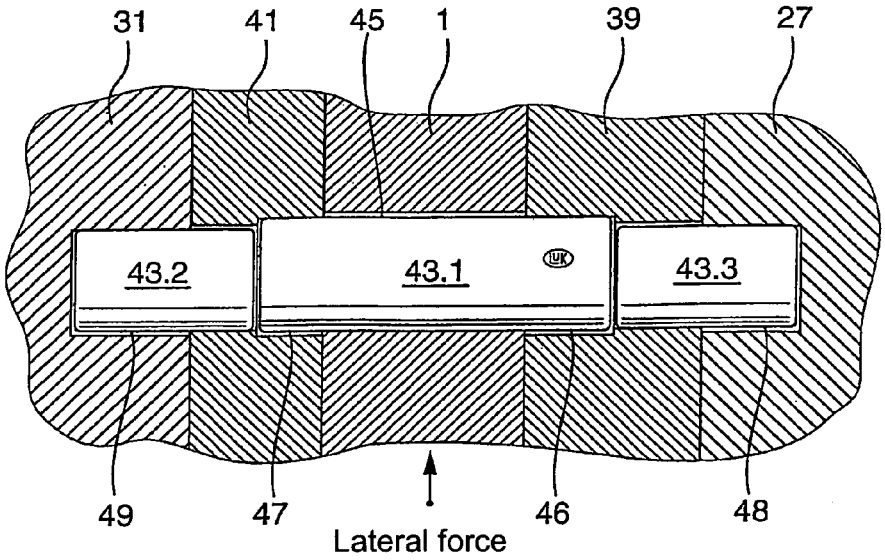
Fig. 3.2

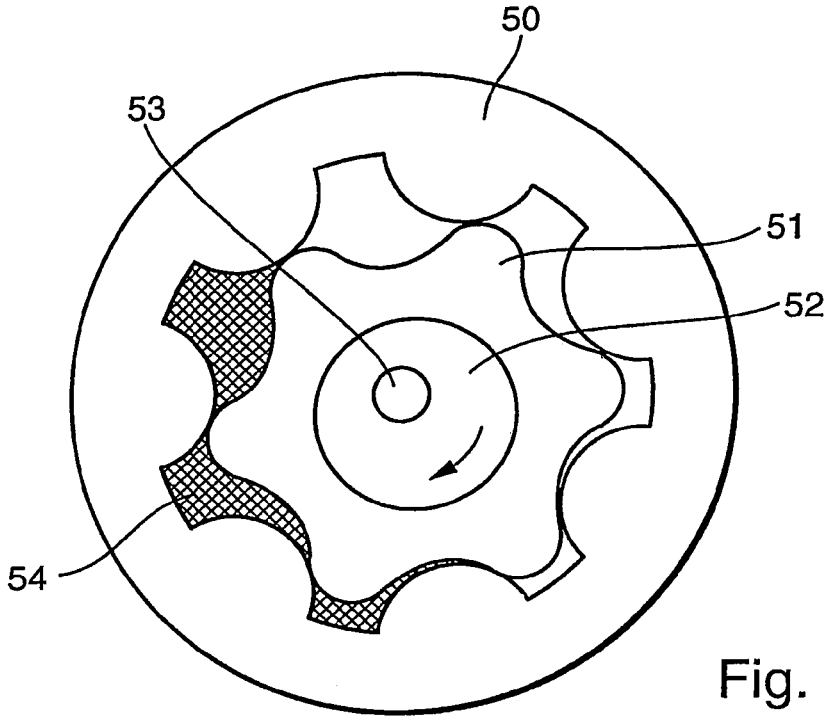
Fig. 4.1
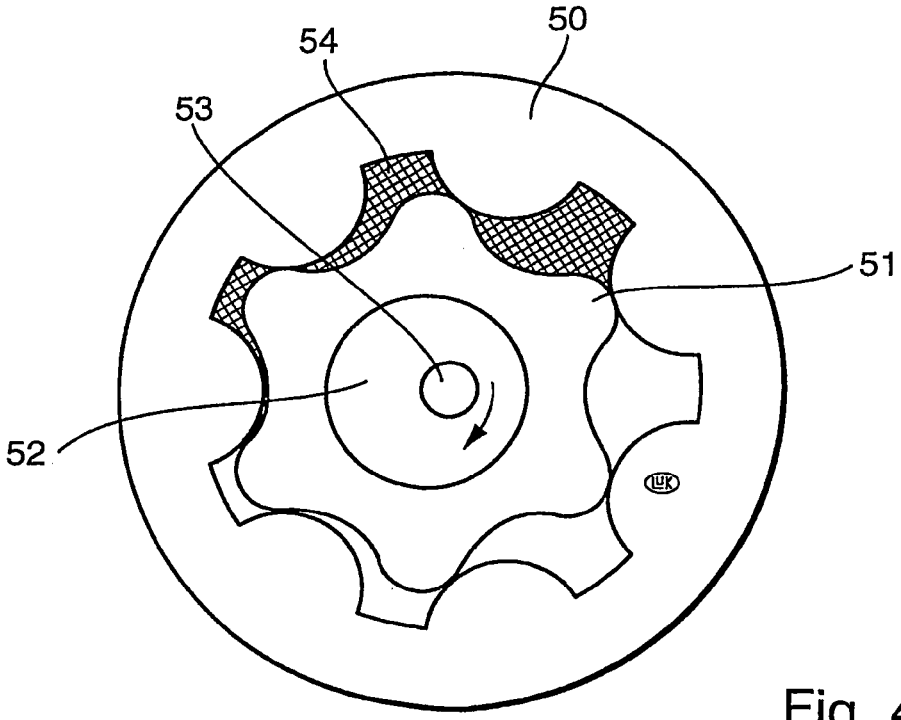
Fig. 4.2

PUMP

BACKGROUND

The present invention relates to a pump, in particular a vane cell pump or a roller cell pump, the vane cell pump or roller cell pump having a double-stroke contour ring and a rotor in which vanes or rollers are radially displaceably mounted, having at least one, possibly two, side plates which laterally seal the rotary cell group, having a housing and a housing cover, the rotor being driven by a shaft and the shaft being supported in the housing and possibly in the cover.

The present invention relates in particular to a double-flow vane cell pump, this double-flow, double-stroke vane cell pump being able to shut off one pump section at higher rotational speeds if needed due to the separation into two pump sections, and the pumped quantity of this pump section being returnable into the suction line. This shut-off has the effect that the rotor and the stroke ring are no longer pressure-equalized in the radial direction since almost no pressure is built up in the shut off pump section. This results in a lateral force which acts on the rotor and the stroke ring. When operating pressures increase, this lateral force causes the stroke rings, supported on pins, to be pushed radially more strongly from their original position due to the deflection of the pins. Due to the shaft deflection, the rotor, supported on the shaft, is displaced from its original position in the opposite direction. These displacements have a substantial effect on the noise behavior of the pump.

SUMMARY OF THE INVENTION

The object to avoid these problems is achieved using a pump, in particular a vane cell pump or a roller cell pump, the vane cell pump or roller cell pump having a double-stroke contour ring and a rotor in which vanes or rollers are radially displaceably mounted, including at least one, possibly two side plates, a housing and a housing cover, the rotor being driven by a shaft and the shaft being supported in the housing and possibly in the cover, and, according to the present invention, the stroke ring and at least one side plate being positioned toward one another using at least one first pin and the first pin not passing through the at least one side plate. Moreover, according to the present invention, the at least one side plate and the housing or the cover are positioned with respect to one another using a second pin, the second pin not passing through the at least one side plate and not having contact with the contour ring. According to the present invention, a second side plate and the housing or the cover are positioned with respect to one another using a third pin, the third pin not passing through the second side plate and also not having contact with the contour ring.

In the pump according to the present invention, the first pin and the second pin and possibly the third pin are situated in the same through orifice, but in different components.

A pump is also preferred in which the first pin and the second pin and possibly the third pin each protrude into the side plate up to half of the respective side plate thickness. Moreover, a pump is preferred in which the first pin and the second pin and possibly the third pin are situated in what is known as a "precision drill hole," i.e., they represent what is known as a "precision pin connection" in a round hole.

An additional pump according to the present invention is characterized in that a fourth and a fifth pin are situated in what is known as an "elongated drill hole," there being elongated holes in the side plates and round holes in the cover or possibly in the housing and the stroke ring, and the fourth pin being designed and positioned in principle identical to the first pin and the fifth pin being designed and positioned in principle identical to the second pin.

Also preferred is a pump in which the drill holes are smooth throughout (i.e., they do not have any shoulders), so that the pins are only subjected to shearing stress and not to bending stress.

Moreover, a pump is preferred in which the two pins in the cover (the second pin and the fifth pin) and the third pin in the housing have the same length and the same diameter. Also preferred is a pump in which the two pins (the first pin and the fourth pin) in the stroke ring have the same length and the same diameter.

A further pump according to the present invention is characterized in that the second pin, the third pin, and the fifth pin have a diameter which is different from that of the first pin and the fourth pin and the orifices in the side plates thus have a stepped design. Moreover, a pump is preferred in which the housing has a pot shape. Also preferred is a pump in which the rotary cell group is fixed on the cover. A pump according to the present invention is characterized in that the shaft is additionally supported in the cover.

BRIEF DESCRIPTION OF THE DRAWINGS

The present invention is explained in greater detail in the following on the basis of the figures.

FIG. 3 shows the behavior of the pins according to the present invention under lateral force, and FIG. 4 shows a Gerotor pump where the pins according to the present invention are used.

DETAILED DESCRIPTION

Figure 1:
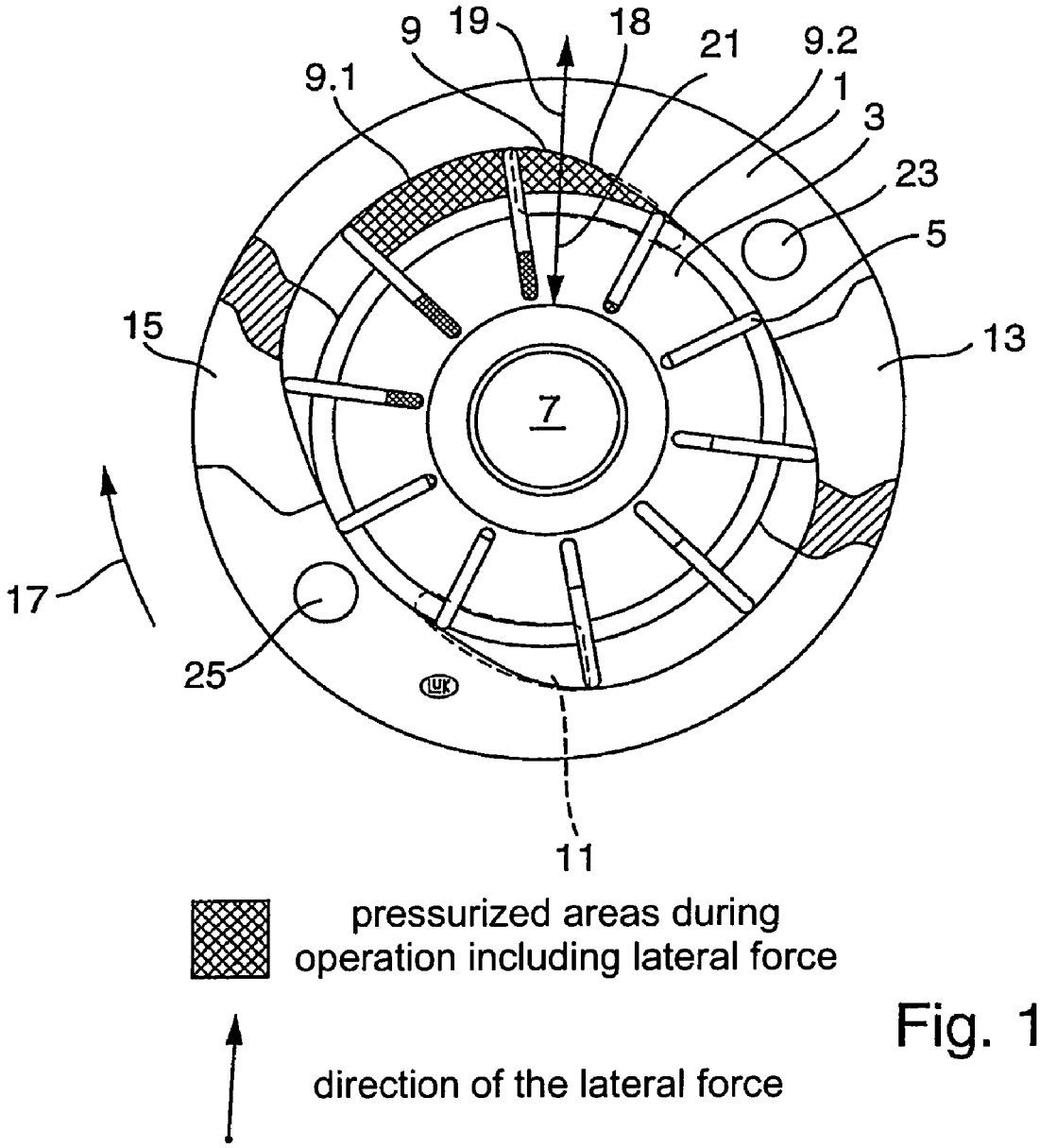
FIG. 1 shows a representation of a vane cell rotary cell group under lateral force.

FIG. 1 shows a rotary cell group of a vane cell pump having only one pressurized area under lateral force.

A rotor 3, which contains radially movable vanes 5 and which is rotatably driven via a shaft 7, is illustrated within a contour ring 1. Vane cells, which expand or contract during rotation, are formed between vanes 5, contour ring 1, and rotor 3. Vane cell 9, a pressure-transmitting cell for example, which, viewed in rotational direction 17, contracts due to "fall" 18, thereby pumping pressurized fluid. The pressure area of the vane cell pump is additionally illustrated in this position by pressure areas 9.1 and 9.2. It thus includes three cells in this position. Lower kidney-shaped pressure area 11 of the vane cell pump should be switched to unpressurized rotation, so that no pressure is generated here. In addition, the two suction areas 13 and 15 of the vane cell pump are illustrated. The pressure build-up in upper pressure area 9 results in a reaction force 19 on contour ring 1 tending to displace contour ring 1 upward, while a pressure force component 21 on rotor 3 tends to displace the rotor downward, which may thus result in impermissibly great deflection of shaft 7 if it does not have an appropriately high rigidity. Contour ring 1 and side plates (not shown here) contain through orifices 23 and 25 via which they are connected to one another and to a housing (not shown here) in which shaft 7 is also supported by pins, so that the circle of forces is closed here.

Figure 2:
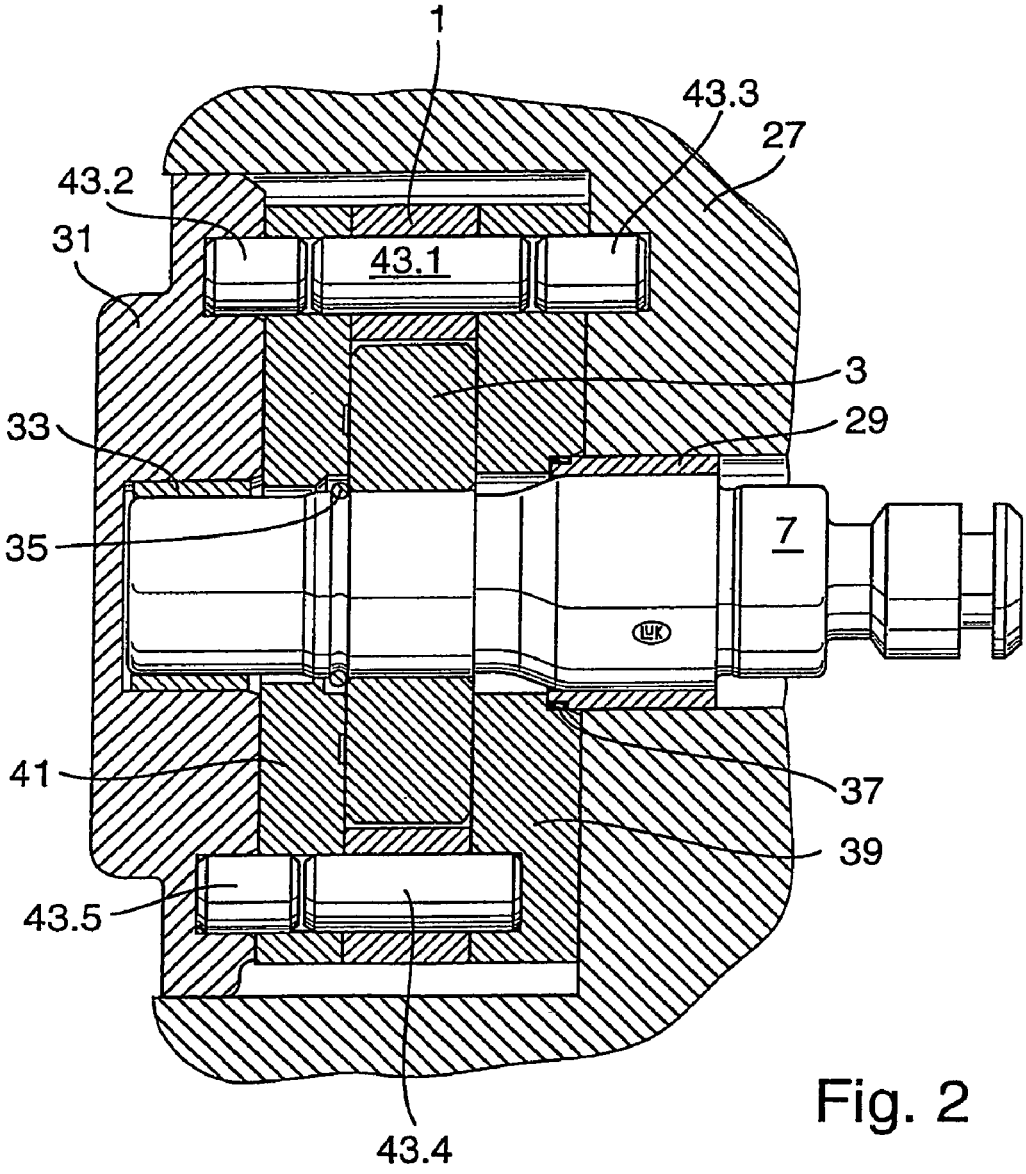
FIG. 2 shows a cross section through a vane cell pump having the pins according to the present invention.

FIG. 2 shows a cross section through a vane cell pump. In a housing 27, shaft 7 is supported via a bearing 29 and is sealed by a seal 37. The housing is closed using a housing cover 31 in which shaft 7 is supported in a second bearing 33.

Contour ring 1, rotor 3 including vanes (not shown), and side plates 39 and 41 form the rotary cell group. Rotor 3 is additionally axially secured on the shaft by a safety ring 35. Stroke ring 1 is connected to side plates 39 and 41, on the top via a first pin 43.1 and on the bottom via a fourth pin 32.4. Moreover, side plate 39 is connected to housing 27 via a short third pin 43.3. Side plate 41 is connected to housing cover 31 via a short second pin 43.2 and a short fifth pin 43.5. If a lateral force according to FIG. 1 is applied in such a way that, due to the pressure in the upper pressure area, contour ring 1 tends to shift upward and rotor 3 tends to shift downward, pin 43.1 is only subjected to shearing stress with respect to side plates 39 and 41 in the pin design illustrated here. If a one-piece through pin were provided instead of a tripartite pin arrangement of pins 43.1, 43.2, and 43.3, then this pin would bend under the respective forces and would generate an additional displacement of ring 1 with respect to rotor 3 due to this deflection. Due to the fact that the deflection is avoided by using the tripartite pin arrangement and that the pins are only subjected to shearing stress, the displacement between contour ring 1 and rotor 3 is definitively smaller and is practically only implemented by the clearance defined by the pin drill holes and the pins. The smaller displacement between stroke ring 1 and rotor 3 results in a definitively lower noise developing in the pump in a single-flow pump operation.

The displacement of the tripartite precision pin system due to the clearances is illustrated in FIGS. 3.1 and 3.2, FIG. 3.2 representing a variant using stepped pins according to claim 11. It can be seen that contour ring 1 is displaced upward with respect to middle pin 43.1 and rests on pin 43.1 on the bottom. The clearance of the precision drill hole connection is represented by upper gap 45. Pin 43.1 in turn rests on side plates 39 and 41 on the top in such a way that a lower gap 46 and 47 is formed here. Side plate 39 in turn rests on the bottom of pin 43.3 whose top in turn rests on housing 27, thus forming a lower gap 48. The same effect occurs on second side plate 41, pin 43.2, and housing cover 31, resulting in the formation of a lower gap 49. The addition of gaps 45, 46, and 48 and 45, 47, and 49 results in the overall displacement of the stroke ring with respect to the housing or the housing cover in which the shaft is supported. The sum of the gap displacements of the components specified here is in any case smaller than a respective deflection of a single pin.

The idea according to the present invention of a multipart bolt bearing may also be used for other applications to convert the problem of a shaft deflection or pin deflection into a shearing stress situation which makes smaller dimensional deviations possible. An internal geared wheel pump of the Orbit pump type is illustrated in FIG. 4 as an example. A gear wheel 51 is situated in an internally geared gear ring 50 which, at the same time, represents the outside contour of the pump component. An eccentric 52 is rotatably situated within gear wheel 51; the eccentric may rotate with respect to gear wheel 51 in a friction bearing and, during this rotary motion, pushes gear wheel 51 successively into the gashes of outside gear ring 50. Eccentric 52 is situated on an eccentric shaft 53. The pump chambers, which perform the actual compression work and thereby build up pressure, are indicated with hatched areas 54. Similar to the above-described vane cell pump, these pressure areas generate a reaction force acting on outside gear ring 50 and on gear wheel 51 and tend to distance the two components in the pressure area from one another. Outside gear ring 50 may be positioned in a pump housing in a relatively stable and immovable manner. More critical is the effect of these pressure areas via gear wheel 51 and eccentric 52 on shaft 53 which drives the eccentric and which is subjected to bending stress due to the pressure forces. With an appropriate design according to the above-described multipart bolt principle, the bending stress situation may be converted into a shearing stress situation in this type of pump system also; the drive of the inside wheel would then be transferred via appropriate couplings. FIG. 4.2 in the lower part of FIG. 4 shows the same pump system haying a different eccentric position which results in the pressure area shifting further as it rotates. This represents the case of stress by a rotating pressure area, while in the vane cell pump the pressure areas were stationary and dependent on the design and the position of the stroke ring.

In known pumps, the torque in the stroke ring and the lateral force generated by the operating pressure are absorbed by a single pin, known as a "precision pin," which is supported in the housing and the cover, and by what is known as an "elongated hole pin" which is only supported in the cover. Most of the lateral force acts only on the precision pin due to the appropriate arrangement of the pins. Only a minor portion of the lateral force acts on the elongated hole pin. The torque is absorbed by both pins, one half each.

In pump operating states where a lateral force is present, the precision pin is subjected to a high bending stress due to the force introduced via the stroke ring and is not able to hold the stroke ring in its position. The stroke ring is radially pressed off-center relative to the rotor. This results in the noise behavior of the pump being adversely affected. The lever arms of the bending stress appear due to the stepped drill holes in the stroke ring and due to the clearances necessary because of assembly reasons between the pin drill holes of the side plate or side plates and the pins.

The stroke ring displacement may be kept very small and the noise, with one pump half shut off and the other pump half under operating pressure, may be substantially improved on using a pin concept according to the present invention in which the pins are not subjected to bending stress, but to shearing stress. For this purpose it is necessary to substitute the "precision hole pin" with three shorter pins (43.1, 43.2, 43.3) and the elongated hole pin with two shorter pins (43.4, 43.5). The drill holes in stroke ring 1 should not be implemented in a stepped manner, but must be smooth throughout. An additional displacement of stroke ring 1 and side plates 39, 41 only occurs due to the clearances between the drill holes and the pins. The sum of the individual clearances is much smaller than the displacement of the stroke ring during a deflection of one "precision hole pin." Due to the support of the "precision hole pin" in cover 31 and housing 27, the "precision hole pin" is subjected to a double-shear stress.

The individual precision pins are situated in the pump as follows: one precision pin 43.3 is fixed in pump housing 27 in a drill hole (round hole) and positions side plate 39 in the rotary cell group space of the pump housing. This precision pin 43.3 protrudes halfway into the round hole in side plate 39. A further precision pin 43.1 also inserted in a round hole through stroke ring 1 protrudes halfway each into side plate 39 and side plate 41 in a round hole connection. A further precision pin 43.2 protrudes halfway into side plate 41 and is fixed in cover 31 in a round hole. The two "elongated hole pins" (43.4, 43.5) are situated in the pump as follows: one "elongated hole pin" 43.5 is fixed in a round hole in cover 31 and protrudes halfway into the elongated hole in side plate 41. A further "elongated hole pin" 43.4 is inserted in a round hole through stroke ring 1 and protrudes halfway into the elongated hole in side plate 41 and halfway into the elongated hole in side plate 39.

The different distances of the round holes in cover 31 and stroke ring 1, due to manufacturing tolerances, is compensated by the elongated holes in the side plates, and cover 31 and stroke ring 1 may be assembled without getting jammed.

In order to avoid problems in the assembly of the pins, the two pins 43.2 and 43.5, supported in cover 31, and pin 43.3, inserted into housing 27, should be designed in such a way that they have the same diameter and the same length. The two pins 43.1 and 43.4, inserted into the stroke ring, should also have the same diameter and the same length. Moreover, in order to prevent wrong assembly of these different types of pins, the drill holes of second side plate 41 and first side plate 39 according to FIG. 3.2 may have a stepped design approximately in the side plate center and their diameters may have a different size corresponding to the different pin diameters. Since, when the pins are appropriately positioned, "elongated hole pins" 43.4, 43.5 have only to absorb the torque, resulting in the occurrence of only negligible forces, there is no need to differentiate between the pins.

The patent claims filed with the application are formulation proposals without prejudice to the achievement of broader patent protection. The applicant reserves the right to claim additional feature combinations previously only disclosed in the description and/or drawing.

The back-references used in the subclaims indicate further refinements of the object of the main claim by the features of the particular subclaim. They are not to be understood as a waiver of obtaining an independent patent for the combination of features of the back-referenced subclaims.

Because the objects of the subclaims may form separate independent inventions with respect to the related art on the priority date, the applicant reserves the right to make them the objects of independent claims or division clarifications. They may furthermore also contain independent inventions having a design that is independent of the objects of the aforementioned subclaims.

The exemplary embodiments are not to be understood as limitations of the present invention. Rather, numerous modifications and variants are possible within the present disclosure, in particular variants, elements, and combinations and/or materials that are obvious to those skilled in the art regarding the achievement of the object of the present invention, for example, by combination or modification of individual features or elements or method steps described in the general description and embodiments as well as in the claims and contained in the drawing, resulting in a new object or new method steps or method step sequences via combinable features, including those concerning manufacturing, testing, and work methods.

What is claimed is:

1. A pump comprising:

a double-stroke contour ring;

a rotor;

vanes or rollers radially displaceably mounted in the rotor;

a side plate for sealing the rotor;

a housing;

a cover for the housing;

a shaft driving the rotor and supported in the housing, a first pin positioning the contour ring with respect to the side plate, the first pin not passing through the side plate; and a second pin positioning the side plate with respect to the housing or the cover, the second pin not passing through the side plate and the second pin not contacting the contour ring;

wherein the first pin and the second pin are situated in a same through orifice, the orifice being located in at least two of the side plate, the contour ring, the housing and the cover.

2. The pump as recited in claim 1 wherein the shaft is also supported in the cover.

3. The pump as recited in claim 1 further comprising a second side plate and a third pin positioning the second side plate with respect to the housing or the cover, the third pin not passing through the second side plate and the third pin not contacting the contour ring.

4. The pump as recited in claim 1 further comprising a third pin and a second side plate, the third pin positioning the second side plate with respect to the housing or the cover and being situated in the same through orifice.

5. The pump as recited in claim 1 wherein the first pin and the second pin each protrude approximately into a middle of a thickness of the side plate.

6. The pump as recited in claim 5 further comprising a third pin and a second side plate, the third pin positioning the second side plate with respect to the housing or the cover, wherein the first pin and the third pin protrude approximately into a middle of a thickness of the second side plate.

7. The pump as recited in claim 1 wherein the orifice is a drill hole having a same diameter.

8. The pump as recited in claim 4 wherein the orifice is a drill hole having a same diameter.

9. The pump as recited in claim 1 wherein the side plate, the contour ring and the housing or the cover have a second through orifice, the second through orifice passing through the side plate and ending in the cover or in the housing, and further comprising a fourth pin and a fifth pin being situated in the second through orifice, the fourth pin being of similar design and axial positioning as the first pin, and the fifth pin being of similar design and axial positioning as the second pin.

10. The pump as recited in claim 1 wherein the orifice has smooth sides so that the first and second pins are subjected to shearing stress and not to bending stress.

11. The pump as recited in claim 9 further comprising a third pin and a second side plate, the third pin positioning the second side plate with respect to the housing or the cover, wherein the second pin, the third pin and the fifth pin have a similar length and diameter.

12. The pump as recited in claim 9 wherein the first pin and the fourth pin have the similar length and similar diameter.

13. The pump as recited in claim 9 wherein the second pin, the third pin, and the fifth pin have a diameter different from the first pin and the fourth pin, the first and second through orifices having a stepped design.

14. The pump as recited in claim 1 wherein the housing has a pot shape.

15. The pump as recited in claim 1 wherein contour ring, rotor, vanes or rollers and the side plate define a rotary cell group, the rotary cell group being fixed to the cover.

16. The pump as recited in claim 1 further comprising a second side plate sealing the rotor.

17. A pump comprising:

a double-stroke contour ring having a first through hole;

a rotor;

vanes or rollers radially displaceably mounted in the rotor;

a side plate for sealing the rotor, the side plate having a second hole extending through the side plate;

a housing;

a cover for the housing;

a shaft driving the rotor and supported in the housing;

a first pin located in the first through hole and the second hole; and a second pin located in the second hole.

* * * * *